US009133648B2

(12) United States Patent
Maltaverne et al.

(10) Patent No.: US 9,133,648 B2
(45) Date of Patent: Sep. 15, 2015

(54) DISENGAGEABLE LOCK

(75) Inventors: Fréderic Maltaverne, Creteil (FR); Christophe Perrin, Creteil (FR)

(73) Assignee: U-Shin France SAS, Créteil Cedex (FR)

( * ) Notice: Subject to any disclaimer, the term of this patent is extended or adjusted under 35 U.S.C. 154(b) by 87 days.

(21) Appl. No.: 13/704,095

(22) PCT Filed: Jun. 29, 2011

(86) PCT No.: PCT/EP2011/060915

§ 371 (c)(1), (2), (4) Date: May 28, 2013

(87) PCT Pub. No.: WO2012/001047

PCT Pub. Date: Jan. 5, 2012

(65) Prior Publication Data

US 2013/0233031 A1 Sep. 12, 2013

(30) Foreign Application Priority Data

Jun. 30, 2010 (FR) ..... 10 02758

(51) Int. Cl.

| | |
|---|---|
| ***E05B 63/00*** | (2006.01) |
| ***E05B 27/00*** | (2006.01) |
| ***E05B 17/00*** | (2006.01) |
| ***E05B 17/04*** | (2006.01) |
| ***E05B 77/00*** | (2014.01) |
| ***E05B 77/44*** | (2014.01) |
| ***E05B 81/54*** | (2014.01) |

(52) U.S. Cl.

CPC ..... *E05B 27/0057* (2013.01); *E05B 17/0058* (2013.01); *E05B 17/04* (2013.01); *E05B 77/00* (2013.01); *E05B 77/44* (2013.01); *E05B 81/54* (2013.01); *Y10T 70/20* (2015.04)

(58) Field of Classification Search

CPC ..... E05B 27/0057; E05B 81/54; E05B 77/44; E05B 17/0058; E05B 17/04; E05B 77/00; E05B 65/0082; E05B 17/2084; E05B 17/2092; E05B 17/0054; E05B 17/0062; Y10T 70/20; Y10T 70/25

USPC ..... 70/1.5, 1.7, 416, 419, DIG. 49, 358, 70/492, 493, 472, 379 R, 379 A, 188–190, 70/422, 222, 223, 237, 418, 421, DIG. 30

See application file for complete search history.

(56) References Cited

U.S. PATENT DOCUMENTS

| | | | | |
|---|---|---|---|---|
| 2,049,742 | A * | 8/1936 | Lowe | 70/379 R |
| 3,651,329 | A * | 3/1972 | Marlowe et al. | 307/10.3 |
| 3,797,004 | A * | 3/1974 | Muessel et al. | 340/529 |

(Continued)

FOREIGN PATENT DOCUMENTS

EP 0 769 598 A1 4/1997

OTHER PUBLICATIONS

International Search Report w/translation from PCT/EP2011/060915 mailed on Sep. 21, 2011 (4 pages).

*Primary Examiner* — Lloyd Gall

(74) *Attorney, Agent, or Firm* — Osha Liang LLP

(57) ABSTRACT

A lock with a disengageable lock cylinder that is part of a mechanism for locking the door of a motor vehicle is disclosed. The lock includes components for detecting an attempt at breaking into the lock, where the components are intended to be connected to a security device of the vehicle.

9 Claims, 3 Drawing Sheets

(56) References Cited

U.S. PATENT DOCUMENTS

Figure 1:
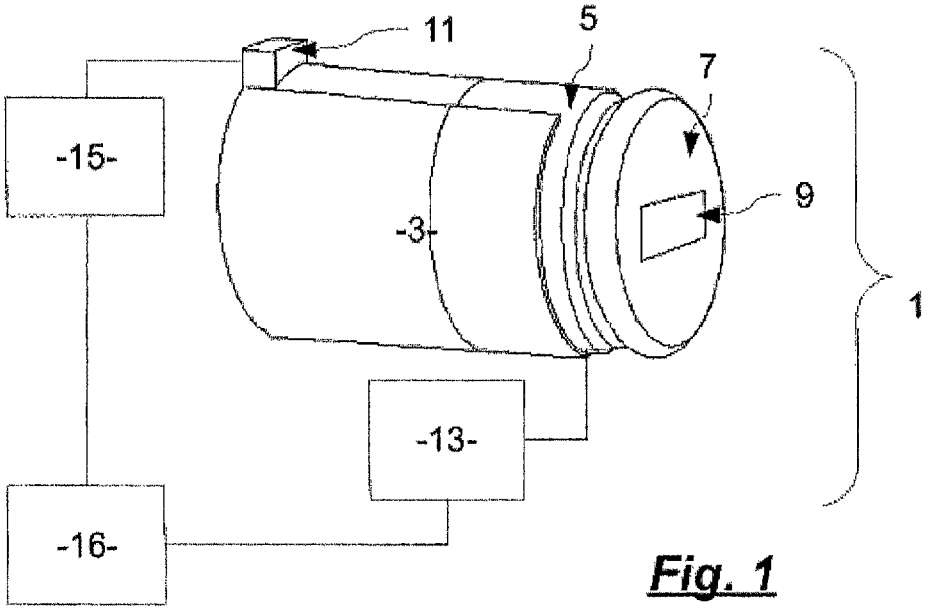

| | | | | | |
|---|---|---|---|---|---|
| 4,035,791 | A | * | 7/1977 | Katayama | 340/522 |
| 4,074,547 | A | * | 2/1978 | Seidewand | 70/1.5 |
| 4,074,548 | A | * | 2/1978 | Milton | 70/1.5 |
| 4,114,412 | A | * | 9/1978 | Braatz | 70/441 |
| 4,148,202 | A | * | 4/1979 | Wegrzyn | 70/431 |
| 4,205,542 | A | * | 6/1980 | Renda | 70/434 |
| 4,565,994 | A | * | 1/1986 | Mochida et al. | 340/542 |
| 4,595,903 | A | * | 6/1986 | Arlasky et al. | 307/10.3 |
| 4,737,762 | A | * | 4/1988 | Ohnishi | 340/426.28 |
| 4,803,460 | A | * | 2/1989 | Rhee et al. | 340/428 |
| 4,875,350 | A | * | 10/1989 | Faust | 70/241 |
| 4,933,663 | A | * | 6/1990 | Holzhauer et al. | 340/568.1 |
| 4,983,947 | A | * | 1/1991 | Mullen et al. | 340/426.28 |
| 4,985,694 | A | * | 1/1991 | Sunami | 340/426.28 |
| 5,229,747 | A | | 7/1993 | Zhao | |
| 5,410,898 | A | * | 5/1995 | Shieh | 70/276 |
| 5,927,112 | A | * | 7/1999 | Yamashita | 70/252 |
| 6,058,751 | A | * | 5/2000 | Dimig et al. | 70/419 |
| 6,568,230 | B1 | * | 5/2003 | Chen | 70/419 |

* cited by examiner

DISENGAGEABLE LOCK

The invention relates to a disengageable lock, in particular designed to be mounted in a mechanism for locking the door of a motor vehicle.

A conventional lock comprises a fixed body, fixedly mounted on the locking mechanism and/or the door, and a lock cylinder of generally cylindrical shape, accommodated in the fixed body and having a housing able to receive a key. A set of tumblers, mobile radially, retains or releases the lock cylinder in rotation relative to the fixed body. The tumblers are displaced when a key is introduced into the housing of the lock cylinder and the lock cylinder is only released in rotation when the key is correct. It is the rotation of the lock cylinder which then triggers the unlocking of the locking mechanism.

As the tumblers are an element of the lock which has relatively little resistance, due to the shape thereof, one technique to force the lock is by using a false key, which is simply able to be a tool such as a screwdriver, to exert sufficiently high torque on the lock cylinder in order to break the tumblers and thus force the rotation of the lock cylinder.

To remedy this type of attack, the principle of disengageable locks is known, according to which principle the lock cylinder is detached from an output unlocking member when it is actuated by force without the tumblers having been displaced with the release of the lock cylinder.

The disengageable locks comprise, for example, an intermediate stator, usually kept attached to the fixed body, and it is this intermediate stator which receives the lock cylinder and the tumblers. When a torque which is too great is exerted on the lock cylinder, said torque transmitted by the tumblers to the intermediate stator results in the release in rotation of the fixed assembly which consists of the lock cylinder, the intermediate stator and the tumblers. The lock is then disengaged.

Also known is a type of disengageable lock in which, when the key is not a correct key, the tumblers circulate in channels having an incline, such that said circulation channels entrain the lock cylinder in translation in its longitudinal direction and, as a result, cause the detachment of the lock cylinder relative to a downstream unlocking chain. Said type of disengageable lock makes it possible to avoid the use of an intermediate stator.

However, once the lock is disengaged, further techniques for breaking-in may be applied. In particular, by introducing a pointed tool (chisel or screwdriver) behind a front part forming the external face of the lock, using blows of a hammer, it is possible to tear the lock cylinder from its housing in the intermediate stator and then act directly on the locking mechanism.

Generally, disengageable locks of the prior art are simply a passive security device and thus are only able to slow down the time taken to break in successfully. To remedy this drawback, the invention proposes a lock with a disengageable lock cylinder.

The disengageable lock may also have one or more of the following features, taken individually or in combination.

The means for detecting an attempted break-in to a lock comprise at least one accelerometer capable of detecting blows to the lock.

The indexing member is able to switch between two positions, an engaged position where the indexing member keeps the intermediate stator fixed in rotation to the fixed body, and a second, retracted position where the intermediate stator is free in rotation, and the means for detecting an attempted break-in to the lock comprise at least one commutator cooperating with the indexing member when switched into the retracted position.

The indexing member comprises at least one external inclined front portion and is arranged so as to move in axial translation when the lock cylinder of the lock is disengaged, the means for detecting a break-in to the lock comprise a pin which is immobile in axial translation and mobile in radial translation, arranged in contact with the external inclined front portion and the commutator so as to be translated axially during the radial movement of the indexing member and then to actuate the commutator.

The indexing member is arranged so as to move in radial translation when the lock is disengaged and is connected to the commutator, and it actuates the commutator when moved in translation.

The means for detecting an attempted break-in to the lock comprise means for detecting the rotation of the intermediate stator relative to the fixed body.

The subject of the invention is also a security device for a motor vehicle comprising at least one disengageable lock according to the invention, in which said disengageable lock is connected to a monitoring unit capable of monitoring at least one means for securing the vehicle.

The device may also have one or more of the following features, taken individually or in combination.

The at least one means for securing the vehicle comprises means for preventing the unlocking of the locking mechanisms when an attempted break-in to the lock is detected.

The at least one means for securing the vehicle comprises means for preventing the start-up of the vehicle when an attempted break-in to the lock is detected.

The at least one means for securing the vehicle comprises means for activating the steering lock when an attempted break-in to the lock is detected.

The at least one means for securing the vehicle comprises means for activating the brakes of the vehicle when an attempted break-in to the lock is detected.

Figure 2:
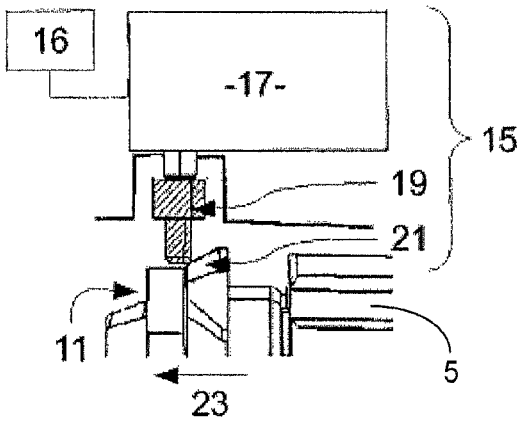
Figure 3:
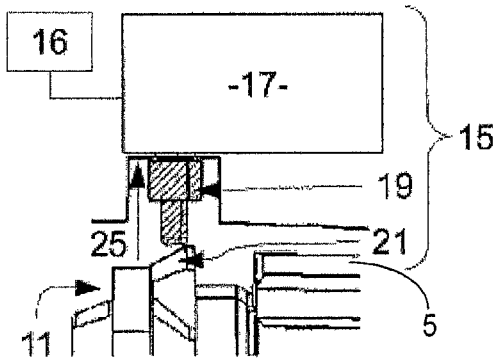
Figure 4:
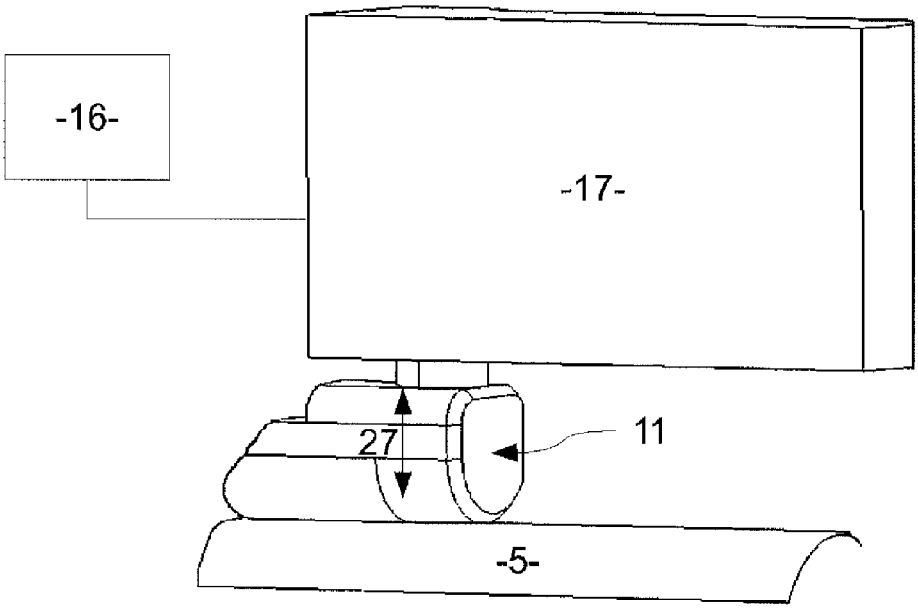
Figure 5:
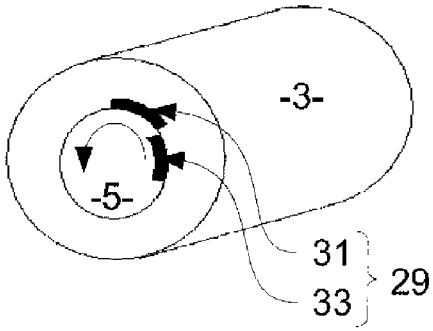
Figure 6:
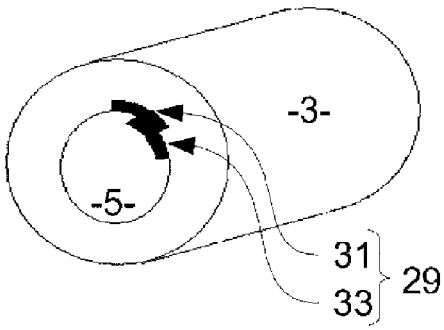
Figure 7:
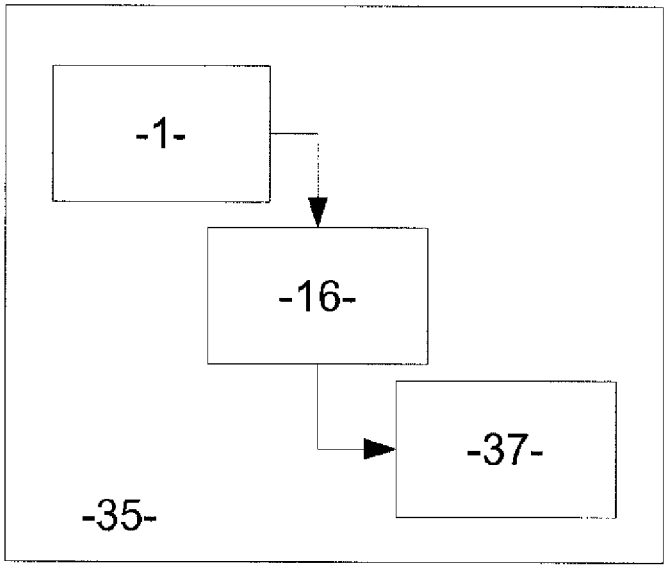

Further features and advantages of the invention will appear from reading the following description of the figures, in which:

FIG. 1 is a schematic perspective view of a disengageable lock according to the invention, FIGS. 2 and 3 are schematic profile views of a first embodiment of the means for detecting the disengagement, FIG. 4 is a schematic perspective view of a second embodiment of the means for detecting the disengagement, FIGS. 5 and 6 are schematic perspective views of an embodiment of a detector of the movement of the intermediate stator of the lock relative to the fixed body, FIG. 7 is a flow chart of a security device for a motor vehicle comprising a disengageable lock according to the invention.

In all the figures, the same reference numerals relate to the same elements.

The subject of the invention is a disengageable lock, in particular for a locking mechanism for a door of a motor vehicle. Such a disengageable lock is shown in FIG. 1. The lock 1 comprises a fixed body 3 designed to be fixedly mounted relative to the locking mechanism. The fixed body 3 is of substantially cylindrical shape and houses an intermediate stator 5, also of substantially cylindrical shape, and mounted so as to be able to rotate relative to the fixed body 3. A substantially cylindrical lock cylinder 7 is positioned in the intermediate stator 5 and mounted so as to be able to rotate relative to the intermediate stator 5.

The lock cylinder 7 may accommodate a key, not shown, in a housing 9.

During operation, locking members, such as a set of pistons or tumblers mounted in radial slots, not shown, prevent the free rotation of the lock cylinder 7 relative to the intermediate stator 5. Only the introduction of the correct key into the housing 9 moves the locking members into a position where the free rotation of the lock cylinder 7 is attempted.

In normal use, an indexing member 11 keeps the intermediate stator 5 fixed relative to the fixed body 3. The indexing member 11 is thus arranged so that it releases the intermediate stator 5 in rotation relative to the fixed body 3, when a torque which is too great is exerted on the lock cylinder 7. In this manner, when an incorrect key or a tool is introduced into the housing 9 and a torque is exerted, the assembly of the lock cylinder 7 and the intermediate stator 5 is released in rotation even when exerting a torque lower than the one that would damage the locking members.

The lock 1 further comprises means for detecting a break-in 13, 15, 29. Said means for detecting a break-in 13, 15, 29 detect the physical intervention on the elements of the lock 1 of a person attempting to open the lock 1 by breaking-in. They are designed to be connected to a security device of the vehicle, in particular a monitoring unit 16 of the vehicle. Said monitoring unit 16, which may for example be an on-board computer, monitors the security means, which may for example be an alarm, the locking of the brakes, the prevention of the release of the steering lock and/or the prevention of the unlocking of the locking mechanisms, within the scope of a security device of which it forms part.

Said means for detecting a break-in 13, 15, 29 comprise, for example, an accelerometer 13 connected to the lock cylinder. Said accelerometer 13 is parameterized to be sensitive to impacts. For example, it may be a piezoelectric or piezoresistive accelerometer. The accelerometer is connected to the monitoring unit 16 and transmits a signal when an impact is detected.

In this manner, when a person attempts to introduce a chisel or screwdriver using hammer blows or to strike directly against the lock, the accelerometer 13 transmits a signal to the monitoring unit 16. The monitoring unit 16 receives the signal and then activates at least one means for securing the vehicle.

The means for detecting a break-in 13, 15, 29 may further or alternatively comprise a disengagement detector 15 cooperating with the indexing member 11. A first embodiment of such a disengagement detector 15 is shown in FIGS. 2 and 3.

The indexing member 11 may switch between two positions, an engaged position where the indexing member 11 keeps the intermediate stator 5 fixed in rotation with the fixed body 3, and a second, retracted position where the intermediate stator 5 is free in rotation, which thus corresponds to the disengaged state of the lock 1. In FIG. 2, the indexing member is in the engaged position. In FIG. 3, the indexing member 11 is in the retracted position which corresponds to axial translation to the left in the figures.

The disengagement detector 15 comprises an electric commutator 17 which cooperates with the indexing member and which is designed to be connected to a monitoring unit 16. The commutator 17 is connected to a pin 19. The pin 19 is in contact with a portion of the external inclined front portion 21 of the indexing member 11. When the indexing member 11 is translated into the retracted position, which the arrow 23 indicates, the pin 19 slides along the portion of the external inclined front portion 21 and is translated axially, which the arrow 25 indicates. This axial movement of the pin 19 activates the commutator 17 which then transmits a signal to the monitoring unit 16 of the vehicle.

An alternative embodiment designed for locks 1, of which the indexing member 11 is displaced radially during its movement into the retracted position, is shown in FIG. 4. In this mounting, the commutator 17 is directly connected to the indexing member 11 which directly activates the commutator 17 during its radial movement, indicated by the double arrow 27.

According to a further embodiment, the disengagement detector 15 may also comprise a magnetic disengagement detector: the indexing member 11 thus comprises a magnet which is approached when an associated device such as a Reed switch (flexible blade switch) is switched into the retracted position.

It is also envisaged to implement the disengagement detector 15 by means of a capacitive, piezoelectric or optical detector.

FIGS. 5 and 6 illustrate a third embodiment of a means for detecting a break-in 13, 15, 29, in the form of rotation detector 29 of the intermediate stator 5 relative to the fixed body 3.

The rotation detector 29 comprises two combined detection elements 31, 33, one 31 fixed to the intermediate stator 5, and the other 33 fixed to the fixed body. Said combined detection elements 31, 33 may, for example, be a Reed switch and a magnet, or even two insulated contacts.

The combined detection elements 31, 33 are thus arranged so that they do not interact when the intermediate stator 5 is in the fixed position corresponding to the engaged state of the lock 1 but a rotation of the intermediate stator 5 relative to the fixed body 3 causes said detection elements 31, 33 to interact and then to trigger the emission of a signal to the monitoring unit 16.

The rotation of the intermediate stator 5 relative to the fixed body 3 is only able to be carried out in the disengaged state, the interaction of the detection elements 31, 33 confirms a disengagement of the lock 1 and thus an attempted break-in.

The break-in detector may also detect an axial translation of the intermediate stator, which typically occurs during the disengagement.

The detector may also detect an axial translation of the lock cylinder at the same time as the translation of the intermediate stator or not, relative to the fixed body, which confirms the disengagement.

Thus, in the case of a disengageable lock without an intermediate stator, such a detection of the translation of the lock cylinder which confirms the disengagement is particularly suitable.

The subject of the invention is also a security device 35 of a motor vehicle comprising a disengageable lock 1 comprising means for detecting a break-in 13, 15, 29 as disclosed above. Such a security device comprises a monitoring unit 16 of the vehicle configured to receive signals from the means for detecting 13, 15, 29 a break-in of the lock 1 and means for securing the vehicle 37, triggered upon the reception of signals from the means for detecting a break-in 13, 15, 29.

The means for securing the vehicle 37 may, for example, comprise means for preventing the unlocking of the vehicle when an attempted break-in of the lock 1 is detected in order to make the unlocking of the locking mechanism at least temporarily impossible by direct action on the mechanism.

The means for securing the vehicle 37 may also comprise means for preventing the start-up of the vehicle when an attempted break-in to the lock 1 is detected, in order to make the start-up of the vehicle at least temporarily impossible even if a person has succeeded in entering the vehicle by breaking-in.

The means for securing the vehicle 37 may further comprise means for preventing the release of the steering lock when an attempted break-in of the lock 1 is detected in order to prevent the release of the steering lock, and thus the driving of the vehicle following a break-in.

Finally, the means for securing the vehicle 37 may further comprise means for activating the brakes of the vehicle when an attempted break-in of the lock is detected, configured to activate the brakes of the vehicle when an attempted break-in of the lock 1 is detected.

The invention thus makes it possible to obtain a security device of a motor vehicle 35 in which the disengageable lock 1 is no longer a passive element but an active element cooperating with the means for securing the vehicle 37 of the security device 35 via a monitoring unit 16. As the lock comprises means for detecting a break-in 13, 15, 29, the disengageable lock 1 enables an automatic response to said break-in, in order to make the theft of the vehicle and/or the contents thereof more difficult, or even impossible.

The invention claimed is:

1. A lock comprising:

a disengageable lock cylinder of a mechanism for locking a door of a motor vehicle;

a fixed body designed to be fixedly mounted to the door;

an intermediate stator held fixedly in rotation with the fixed body;

a lock cylinder comprising a housing able to receive a key;

locking members cooperating with the intermediate stator to hold the lock cylinder fixedly in rotation relative to the intermediate stator and releasing the lock cylinder in rotation relative to the intermediate stator when a correct key is introduced in the housing; and an indexing member blocking the intermediate stator in rotation relative to the fixed body and releasing the intermediate stator when a torque is exerted on the lock cylinder when fixed in rotation relative to the intermediate stator; and means for detecting an attempted break-in to the lock, wherein the lock is connected to a security device of the vehicle, wherein the indexing member may switch between an engaged position where the indexing member keeps the intermediate stator fixed in rotation to the fixed body and a retracted position where the intermediate stator is free in rotation, wherein the means for detecting an attempted break-in to the lock comprise at least one commutator cooperating with the indexing member when switched into the retracted position.

2. The lock as claimed in claim 1, wherein the means for detecting an attempted break-in to the lock comprise at least one accelerometer capable of detecting blows to the lock.

3. The lock as claimed in claim 1, wherein the indexing member comprises at least one external inclined front portion and is arranged so as to move in axial translation when the intermediate stator is released in rotation relative to the fixed body and in that the means for detecting a break-in to the lock comprise a pin which is immobile in axial translation and mobile in radial translation, arranged in contact with the external inclined front portion and the commutator so as to be axially translated during the movement of the indexing member and then to actuate the commutator.

4. The lock as claimed in claim 1, wherein the indexing member is arranged so as to move in radial translation when the intermediate stator is released in rotation relative to the fixed body and is connected to the commutator and in that the indexing member actuates the commutator when moved in translation.

5. The lock as claimed in claim 1, wherein the means for detecting an attempted break-in to the lock comprise means for detecting a displacement of the intermediate stator relative to the fixed body.

6. The lock as claimed in claim 5, wherein the means for detecting an attempted break-in to the lock comprise means for detecting a rotation of the intermediate stator relative to the fixed body.

7. The lock as claimed in claim 5, wherein the means for detecting an attempted break-in to the lock comprise means for detecting an axial translation of the intermediate stator relative to the fixed body.

8. The lock as claimed in claim 5, wherein the means for detecting an attempted break-in to the lock comprise means for detecting an axial translation of the lock cylinder relative to the fixed body.

9. A motor vehicle security device comprising:

at least one disengageable lock as claimed in claim 1, wherein said disengageable lock is connected to a monitoring unit capable of monitoring at least one means for securing the vehicle.

* * * * *